US005533341A

United States Patent [19]

Schvester et al.

[11] Patent Number: 5,533,341

[45] Date of Patent: Jul. 9, 1996

[54] APPARATUS AND METHOD FOR PRODUCING AND INJECTING STERILE CRYOGENIC LIQUIDS

[75] Inventors: Pascal Schvester, Chicago; Richard A. Sauer, Hinsdale, both of Ill.

[73] Assignee: Air Liquide America Corporation, Houston, Tex.

[21] Appl. No.: 475,998

[22] Filed: Jun. 7, 1995

[51] Int. Cl.[6] ..... F17C 7/02

[52] U.S. Cl. ..... 62/50.1; 62/908; 422/28

[58] Field of Search ..... 62/14, 15, 50.1; 422/28

[56] References Cited

U.S. PATENT DOCUMENTS

| | | | |
|---|---|---|---|
| 3,415,069 | 12/1968 | Hauser | 62/40 |
| 3,974,068 | 8/1976 | Ebner et al. . | |
| 4,150,548 | 4/1979 | Kemp et al. . | |
| 4,337,071 | 6/1982 | Yang | 62/14 |
| 4,431,545 | 2/1984 | Pall et al. . | |
| 4,620,962 | 11/1986 | Brodbeck . | |
| 4,759,848 | 7/1988 | Segura et al. . | |

FOREIGN PATENT DOCUMENTS 3342440 6/1985 Germany .

OTHER PUBLICATIONS

"Chem–Line II PF Disposable Filters", Chemical Products.
"BM Series Bellows Metering And Regulating Valves", NUPRO.
"DS Series Diaphragm Valves", NUPRO.
"Membralox ceramic gas filters", U.S. Filter.

*Primary Examiner*—Ronald C. Capossela
*Attorney, Agent, or Firm*—Burns, Doane, Swecker & Mathis

[57] ABSTRACT

An apparatus for producing and injecting a sterile cryogenic liquid (for example into a container of food) is provided, as well as a method of use of same. The apparatus includes at least one purge-swept cryogenic liquid filter, the filter including filter media having the capability to effectively sterilize cryogenic liquids, the filter media positioned within a housing to accept non-sterile cryogenic liquid and produce sterile cryogenic liquid, and to recycle an amount of the non-sterile cryogenic liquid. The apparatus further includes at least one sterile cryogenic liquid accumulator, the sterile cryogenic liquid accumulator having a sterile cryogenic liquid outlet for dispensing sterile cryogenic liquid, the sterile cryogenic liquid outlet having a passageway for a sterile cryogenic gas, whereby the sterile cryogenic gas prevents contact of the sterile cryogenic liquid with a non-sterile atmosphere via pressurization and purging during dispensing of same.

19 Claims, 4 Drawing Sheets

APPARATUS AND METHOD FOR PRODUCING AND INJECTING STERILE CRYOGENIC LIQUIDS

BACKGROUND OF THE INVENTION

1. Field of the Invention

The present invention relates generally to cryogenic liquids and gases. In particular the present invention relates to the production and injection of a sterile cryogenic liquid in a manner which safeguards the sterility of the cryogenic liquid until it is dispensed.

2. Related Art

Cryogenic liquids and gases of high purity, such as nitrogen, helium, argon and the like, are preferred for a variety of industries. The semiconductor industry, for example, prefers ever increasingly purer nitrogen as a carrier gas for reactive species in the production of semiconductors.

Another industry desiring high purity inert gases is the food packaging industry, more particularly the canned food industry. Aluminum cans are being increasingly used in retail sales of soft drinks, fruit juices, coffee beverages, and the like. Aluminum cans, which can be made in two pieces, are often less expensive to produce than competing three piece cans. However, aluminum cans often do not have the compressive strength of steel cans, making the stacking of aluminum-canned food higher than a minimal height very difficult: the cans at the bottom of the stack are likely to fail. This is of course undesirable for a variety of reasons. Failure of cans could cause the food or beverage to leak from the can, causing slip-and-fall hazards for workers or store customers, and the spillage of food is often distasteful in terms of eye appeal, or because of foul smell. Therefore, if aluminum cans are to be used, it is desirous to use cryogenic liquids in droplet form dispensed into the can just before and/or during the sealing procedure. The cryogenic liquid vaporizes via heat transfer from the surroundings, and expands and thus pressurizes the can.

The use of inert, sterile cryogenic liquids in aluminum canning is known, and methods and apparatus are described in U.S. Pat. Nos. 4,620,962 and 4,759,848. the '962 patent is directed to a method and apparatus to make sterile cryogenic liquid, wherein the cryogenic liquid to be sterilized is first vaporized, then sterilized as a gas and finally reliquified to provide sterile cryogenic liquid. Vaporization is carried out in a heat exchanger which is also used to cool the sterilized gas. The '848 patent discloses a method and an apparatus to sterilize a cryogenic liquid, wherein the unsterilized cryogenic liquid is provided in liquid (saturated) state to a microporous filter submerged in a subcooling cryogenic liquid having a temperature cooler than the saturated stream, the cryogenic liquid being thus sterilized and subcooled. The purpose of subcooling is to prevent the formation of gas bubbles in the saturated stream and, therefore, assures that the saturated liquid can pass quickly through the pores of the filter. These methods and apparatus, while producing sterile cryogenic liquids and gases, do not disclose or suggest means for maintaining the sterility of the sterile cryogenic liquid.

A problem that still presents itself to the user of sterile cryogenic liquids is the fact that the bulk cryogenic liquid supply is not sterile. Further, even if a supply of sterile nitrogen were available, in many instances a metering device, such as a needle valve or metering pump, is used to dispense the sterile liquid. These metering devices typically have very small outlet nozzles which can easily become clogged with ice formed from water vapor in the surrounding air as the drops of liquid cryogen are dispensed into the can. Ambient air is, of course, not sterile, and thus contamination of the food or semiconductor or other product is an acute problem. It is of course possible in theory to provide a "clean room" for the dispensing area, where the atmosphere is sterile, but this may be cost prohibitive when large food canning lines or other production lines are involved.

There is therefore an unmet need for a method and apparatus which simply and efficiently produces sterile cryogenic liquids from the bulk raw supply, ensures the sterility of the cryogenic liquid, particularly under a variety of canning line conditions, and manages the injection of the sterile liquid cryogen into food products.

SUMMARY OF THE INVENTION

The present invention overcomes many deficiencies of the prior art in providing good quality sterile liquid cryogens. The high quality of the cryogenic liquids produced by the method and apparatus of the invention is maintained by use of a sterile cryogenic gas purging system to pressurize the apparatus and create a sterile zone which essentially prevents contact of the sterile cryogenic liquid with non-sterile atmospheres.

In accordance with one aspect of the present invention, an apparatus for producing and injecting a sterile cryogenic liquid is described, the apparatus comprising:

(a) at least one purge-swept filter, each filter comprising:
  (i) a filter housing,
  (ii) a non-sterile cryogenic liquid inlet,
  (iii) a non-sterile cryogenic liquid purge stream outlet,
  (iv) a sterile cryogenic liquid outlet, the inlet and both outlets connected to the filter housing, and
  (v) filter media having the capability to effectively sterilize non-sterile cryogenic liquids (preferably able to remove microbes of size less than 0.45 micrometers, more preferably less than 0.2 micrometers), the filter media positioned within the housing to accept non-sterile cryogenic liquid and produce sterile cryogenic liquid;

(b) at least one sterile cryogenic liquid accumulator which receives sterile cryogenic liquid from at least one filter via the sterile cryogenic liquid outlet; and (c) an accumulator outlet for delivering sterile cryogenic liquid from the accumulator to a desired location, the accumulator outlet having a first passageway for the sterile cryogenic liquid and a second passageway for a sterile cryogenic gas, the sterile cryogenic gas delivered through the second passage way substantially preventing contact of the sterile cryogenic liquid with a non-sterile atmosphere during dispensing of the sterile cryogenic liquid.

It will be understood that preferred apparatus embodiments will comprise optional equipment. For example, the sterile cryogenic gas may be produced "on site", and thus the inventive apparatus will preferably include a first cryogenic gas sterilization filter, the first cryogenic gas sterilization filter having a non-sterile cryogenic gas inlet which is in turn connected to a source of non-sterile cryogenic gas, and a sterile cryogenic gas outlet, the sterile cryogenic gas outlet connected to the first sterile cryogenic gas passageway. Preferred apparatus embodiments in accordance with the invention are those wherein the accumulator comprises a gas vent connected to the second sterile cryogenic gas passageway, and between the accumulator and the gas vent there is provided a second cryogenic gas sterilization filter and a back-pressure control valve, thus ensuring the accumulator has a positive pressure to prevent back contamination from the atmosphere upon pressure letdown at the backpressure controller. The sterile cryogenic gas outlet is also preferably connected with the second sterile cryogenic gas passageway.

The inventive apparatus typically and preferably includes on the sterile cryogenic liquid inlet an accumulator level control valve interfaced with an accumulator level detector and accumulator level control unit; the sterile cryogenic liquid outlet preferably includes a connection to allow steam or other regeneration material such as solvents to enter at least non-sterile sections of the apparatus to kill microbes; and at least the filter housing, and all vessels and tubing, typically and preferably comprise a steam condensate drain. Another preferred apparatus in accordance with the invention is that wherein the non-sterile cryogenic liquid purge stream outlet includes a pump to return the non-sterile liquid to the non-sterile cryogenic liquid source.

As used herein, the terms cryogenic liquid and cryogenic gas refer to single component or compositions comprising more than one of argon, nitrogen, helium, krypton, nitrous oxide and the like. Further, a cryogenic liquid is saturated, and not subcooled, although a de minimis amount of subcooling may actually occur. Although the liquid filter housing and all piping is preferably vacuum jacketed, it is contemplated that heat gain from the atmosphere will substantially prevent subcooling in most if not all embodiments, thus the presence of gas phase in the filter is to be expected. Preferably the accumulator further comprises a vent through which sterile cryogenic gas is vented, thus ensuring the accumulator has a positive pressure (i.e. greater than atmospheric pressure) to prevent back contamination from the atmosphere.

The term purge-swept filter means that at least an outer surface of the filter media is continually exposed to a flowing stream of non-sterile cryogenic liquid, thus carrying any gas phase in the form of bubbles away from the filter media. This prevents the build-up of gas phase in the filter media so that the gas phase does not substantially obstruct the flow of cryogenic liquid through the filter media.

Another aspect of the invention is a method of producing and dispensing a sterile cryogenic liquid, the method comprising the steps of:

(a) providing a non-sterile cryogenic liquid, the liquid comprising at least submicron microbes, the non-sterile cryogenic liquid being saturated;

(b) directing the non-sterile cryogenic liquid into at least one purge-swept cryogenic liquid filter, each liquid filter comprising:
  (i) a filter housing,
  (ii) a non-sterile cryogenic liquid inlet which accepts non-sterile cryogenic liquid from a source,
  (iii) a non-sterile cryogenic liquid purge stream outlet,
  (iv) a sterile cryogenic liquid outlet, the inlet and both outlets connected to the filter housing, and
  (v) filter media having the capability to effectively sterilize cryogenic liquids, the filter media positioned within the housing to accept non-sterile cryogenic liquid and produce sterile cryogenic liquid;

(c) withdrawing a sterile cryogenic liquid from the liquid filter and directing it to a sterile cryogenic liquid accumulator, the accumulator having a sterile cryogenic liquid inlet which receives the sterile cryogenic liquid from the at least one liquid filter via the sterile cryogenic liquid outlet, the sterile cryogenic liquid inlet having a first sterile cryogenic liquid passageway and a first sterile cryogenic gas passageway, the sterile cryogenic liquid accumulator also comprising a sterile cryogenic liquid outlet for dispensing sterile cryogenic liquid, the sterile cryogenic liquid outlet having a second passageway for sterile cryogenic liquid and a second passageway for a sterile cryogenic gas, whereby sterile cryogenic gas is delivered through the second sterile cryogenic gas passageway and substantially prevents contact of the sterile cryogenic liquid with a non-sterile atmosphere during dispensing of same;

(d) directing non-sterile gaseous cryogen to at least one sterilizing gas filter and directing sterilized gaseous cryogen from the gas filter to the first and second gas passageways for sterile cryogenic gas; and (e) dispensing the sterile cryogenic liquid from the accumulator.

Preferred methods are those wherein there is a plurality of liquid filters, for example, wherein one liquid filter is in sterilization mode and the others of the plurality of liquid filters are in steam regeneration mode, and methods wherein all of a plurality of liquid filters are either in regeneration mode or in sterilization mode at any given time. As used herein the term sterilization mode means the filter media is removing microbes from non-sterile liquid and/or gaseous cryogen, whereas the term regeneration mode means the filter media is exposed to a regeneration media, preferably steam having a temperature of at least 250° F. (121° C.). Methods wherein after a certain time period all flows are stopped, non-sterile and sterile liquid and gaseous cryogen are removed from the liquid and gaseous filters, and a regeneration material is introduced into the filters and all associated non-sterile equipment for a time and at a rate sufficient to regenerate the filters and equipment are also preferred.

It will be understood that the method steps may be performed simultaneously in a continuous operation, or the liquid filter may operate for a time to produce a batch of sterile liquid cryogen to fill the accumulator, after which the liquid flow to the liquid filter is interrupted and the dispensing step commenced. Many variations will become apparent to those skilled in the art.

The invention will be more fully understood with reference to the following detailed description of the invention and drawing figures.

The figures are not to scale and are merely illustrative of the invention.

DESCRIPTION OF PREFERRED EMBODIMENTS

The components of preferred apparatus embodiments of the invention will now be described in detail, component by component, as well as preferred method embodiments.

I. Apparatus

A. General Description

Figure 1:
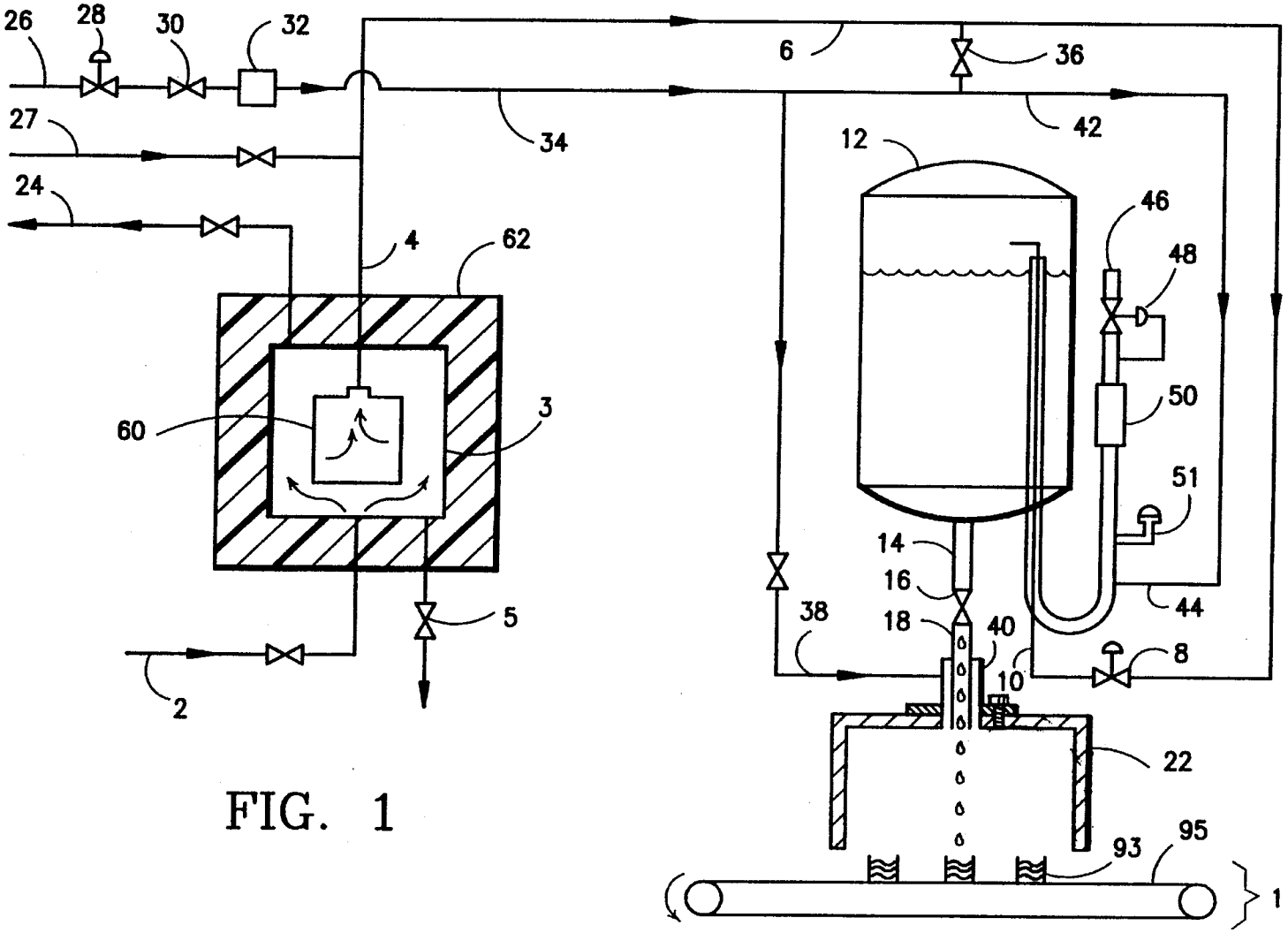
FIG. 1 is a schematic view (reduced) of an apparatus in accordance with the present invention.

Referring to FIG. 1, there is illustrated in schematic an apparatus in accordance with the present invention. It is instructive to follow the path of liquid cryogen first. Thus, non-sterile liquid cryogen enters the apparatus via a conduit 2, passes through a liquid cryogen filter 3, and exits as sterile liquid cryogen via a conduit 4. Conduit 4 directs sterile liquid cryogen via another conduit 6 past a level control valve 8, through another conduit 10, and ultimately into a sterile liquid cryogen accumulator 12. At the lower end of accumulator 12 is a sterile liquid cryogen dispensing arrangement comprising a sterile cryogenic liquid accumulator outlet conduit 14, a sterile cryogenic liquid metering valve 16, the latter producing drops of liquid cryogen which pass through conduit 18 and on into a customer's aseptic packaging container 93. A hood 22 is typically present, and is bolted or otherwise fastened to sheath 40 (see FIG. 2). The sterile cryogenic liquid dispensing arrangement is more fully described below in reference to FIG. 2.

Figure 4:
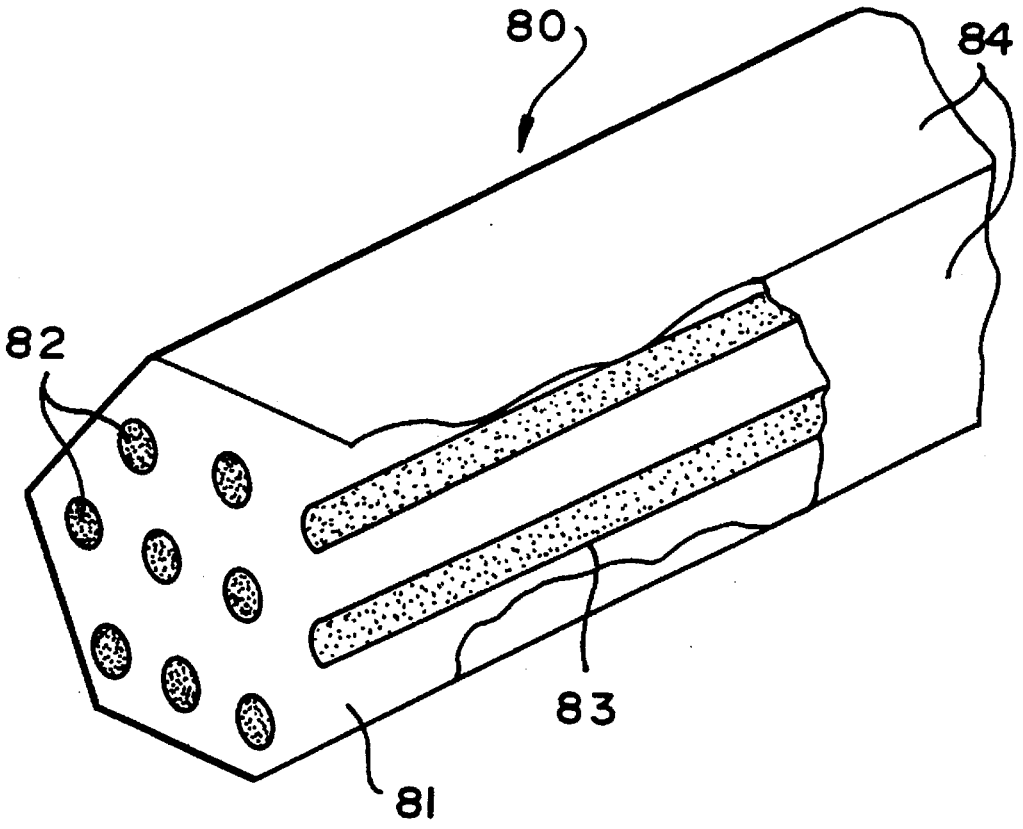
FIG. 4 is a perspective view of a ceramic filter media useful in the invention.

Referring again to FIG. 1, in particular cryogenic liquid filter 3 includes filter media 60 (more fully described below with reference to FIG. 4), a steam condensate drain 5, and a recycle conduit 24 which returns non-sterile cryogenic liquid having gas phase therein to its source.

Following now the cryogenic gas streams (again referring to FIG. 1), non-sterile cryogenic gas enters the system through conduit 26, pressure reducing valve 28, hand valve 30 and a microporous cryogenic gas filter 32. Sterile cryogenic gas passes through a series of conduits 34, 36, 38 and 42 to provide purge streams of sterile cryogenic gas throughout the apparatus. For example, conduit 38 terminates at sheath 40 and provides a purge stream of sterile gaseous cryogen around the flow of sterile liquid cryogen from accumulator outlet conduit 18. Conduit 42 also provides sterile gaseous cryogen to accumulator 12 by entering a vent conduit 44. Vent conduit 44 terminates at a vent to the atmosphere at 46. A back pressure regulator 48 maintains positive pressure in accumulator 12, and restricts any possible backflow of air into the apparatus through vent 46. Should any air invade the apparatus through vent 46, another microporous gas filter 50 is provided to sterilize the air. A rupture disc 51 is also typically provided for additional safety in case of overpressure of accumulator 12 or misfunction of back pressure regulator 48. The intent of the pressurization and purging with sterile gas is to maintain the liquid in a sterile condition.

Figure 3:
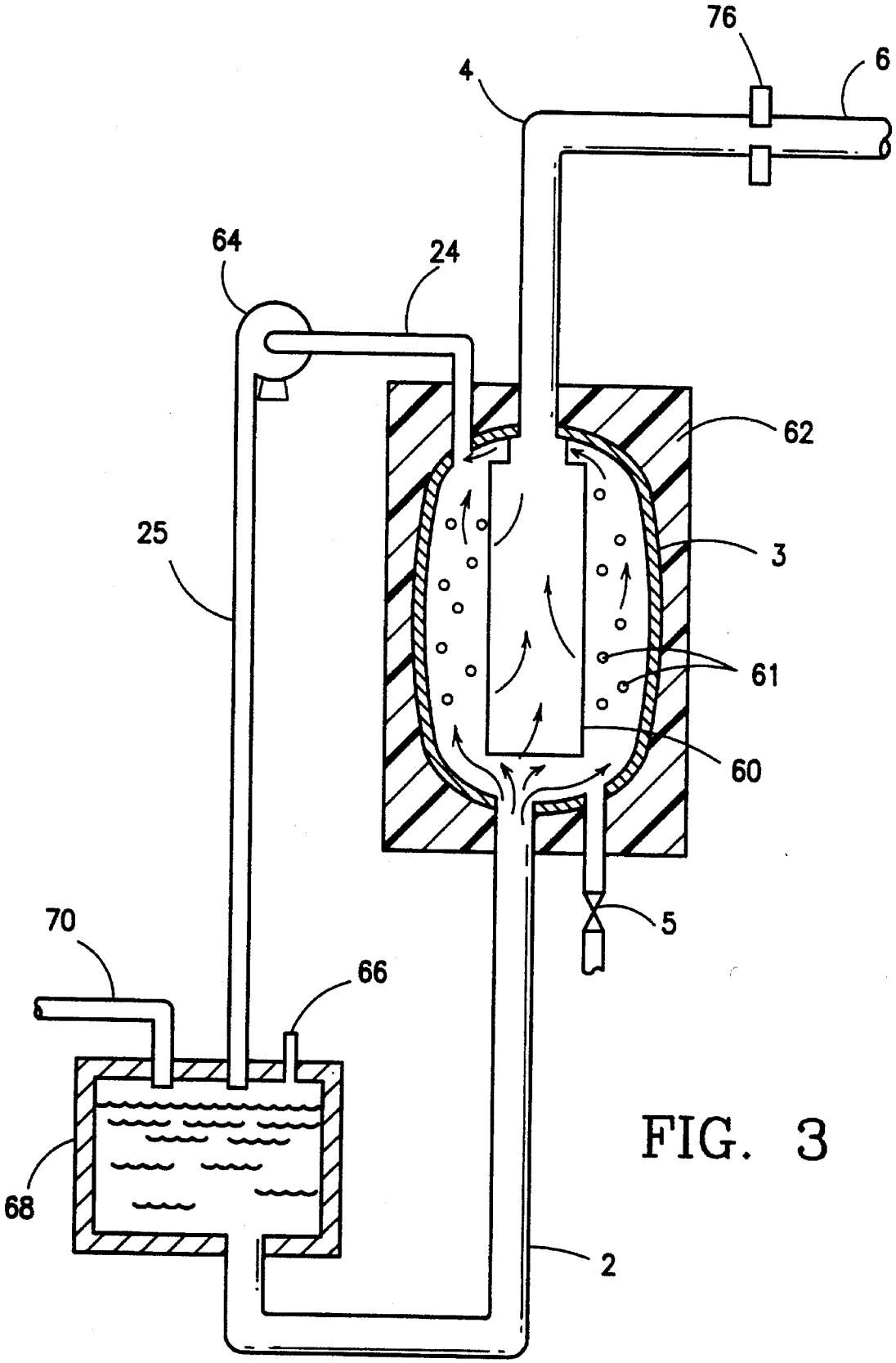
FIG. 3 is a schematic view (reduced) of a liquid cryogen filter and associated piping useful in the apparatus and method of the invention.

A conduit 27 is connected to the sterile liquid cryogen outlet 4. Conduit 27 provides an access point to allow a regeneration material to enter the apparatus to kill microbes which have been filtered out of the non-sterile cryogenic liquid and gas. Typically and preferably the regeneration material is steam as previously mentioned, and various steam condensate drains 5 are provided at low points in the apparatus, such as illustrated in FIGS. 1 and 3 on filter housing 3; however, it is conceivable that other liquid and/or gaseous compositions may be useful for the killing of the microbes. For example, sterilized and heated gases such as air, nitrogen, carbon dioxide, ethylene oxide, and the like may be used, depending on the availability of each. Further, it may be possible to use sterile liquids, such as hydrogen peroxide, and the like. Essentially any material that will kill microbes such as *pseudomonas diminutia* and the like may be employed.

B. Sterile Cryogenic Liquid Dispensing Arrangement

Figure 2:
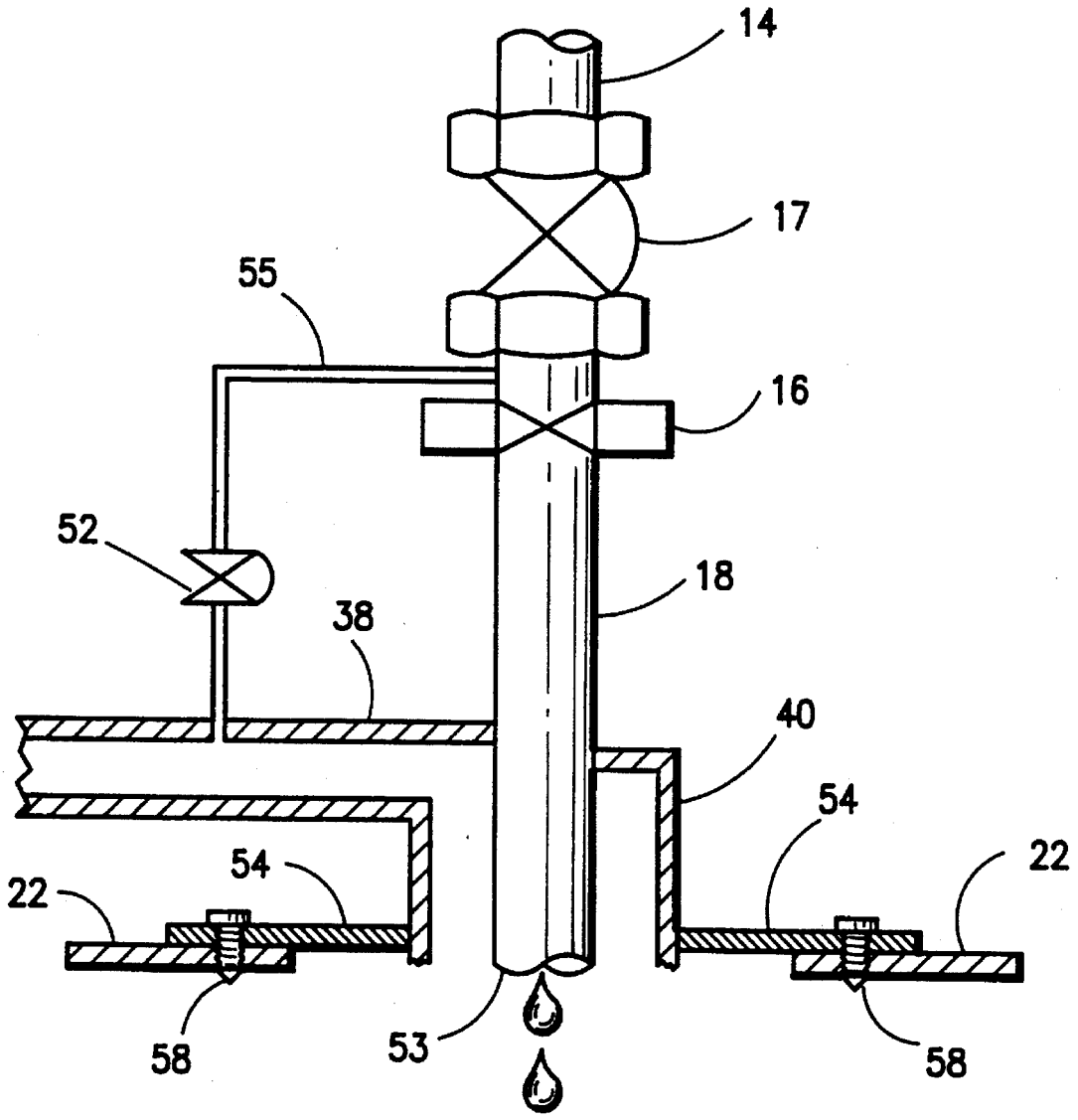
FIG. 2 is a schematic view (enlarged) of a sterile liquid cryogen injection component in accordance with the present invention.

Perhaps the salient feature of the inventive apparatus is the provision of sterile cryogenic gas through conduit 38 and sheath 40, which direct sterile cryogenic gas around the periphery of sterile cryogenic liquid conduit 18. This of course is intended to ensure the sterility of the sterile cryogenic liquid as it is being dispensed into the customer's container. FIG. 2 illustrates this concept in greater detail. Sterile cryogenic gas enters through conduit 38 and on into sheath 40 and generally prevents the formation of ice on a dispensing nozzle 53. The dispensing arrangement includes a metering valve 16, diaphragm or bellows valve 17, and conduit 14 which directs sterile cryogenic liquid from accumulator 12 (FIG. 1) into the dispensing arrangement. Another diaphragm or bellows valve 52, when opened, allows sterile gaseous cryogen to purge metering valve 16 (and internals of liquid tubing and nozzle 53) as desired. Hood 22 is illustrated as bolted onto an extension 54 of sheath 40 using bolts 58.

Although not depicted in any figure, it is sometimes preferred to employ a heating unit near the vicinity of dispensing nozzle 53 to further ensure against freeze-up of the nozzle.

C. Cryogenic Liquid Filters

The cryogenic liquid filter functions to sterilize liquid cryogen for use in a customer operation, such as an aseptic food canning line. As used herein sterilization will take different meanings in accordance with the customer or end user's needs. In terms of the food packaging industry, sterilization means the removal of microbes having a size of 0.45 micrometers or larger, more preferably 0.2 micrometers or larger. This degree of sterilization is probably the same for the medical industry for the supply of oxygen. In the semiconductor or microelectronics industry, sterilization may mean the removal of microbes and other particulate matter having a size greater than 0.1 micrometers. It is expected that the semiconductor industry will continue to demand even greater purity gases and liquids, so that these numbers are bound to change (decrease) with time.

Referring to FIG. 3, a purge-swept cryogenic liquid filter is a rather simple device in construction, other than the requirement of the filter media 60 having the ability to provide the desired purity. Non-sterile cryogenic liquid enters filter housing 3 through conduit 2 from a reservoir 68, while sterile cryogenic liquid leaves via conduits 4 and 6. Because the non-sterile cryogenic liquid enters in saturated condition, heat gain from the surroundings inevitably produces gas phase in the form of bubbles 61, although it is desired to maintain the temperature of the filter as low as possible using an insulation system 62, which is preferably a vacuum jacket. Non-sterile cryogenic liquid and bubbles exit filter housing 3 through recycle conduit 24, pump 64, and flows through conduit 25 back to reservoir 68. Thus non-sterile cryogenic liquid returns to reservoir 68, while any bubbles are exhausted to the surroundings at vent 66. Non-sterile cryogenic liquid is provided via feed conduit 70 to maintain a level in reservoir 68. A restriction orifice 76 is provided between sterile cryogenic liquid product conduits 4 and 6 to regulate or give an indication flow of sterile cryogenic liquid into accumulator 12 (FIG. 1). As there is a significant pressure drop at this point due to the orifice, gas phase bubbles may form in the sterile cryogenic liquid, but they are removed in accumulator 12.

The filter media and housings (as well as most conduits, the accumulator, and associated mechanical equipment) useful in the invention preferably withstand temperatures ranging from −320° F. to about 300° F. (−196° C. to about 150° C.).

Liquid filter media 60 is of course an important component of the apparatus, as discussed above. One useful filter media are the ceramic filter media available under the trade designation MEMBRALOX, which are available from SCT, Tarbes, France, a subsidiary of U.S. Filter Co., of Pittsburg, Pa. A filter media of this type is illustrated perspectively in FIG. 4. Filter media 80 generally comprises a high purity, sintered ceramic material with a precisely calibrated pore size. The ceramic material comprises a multichannel support element 81 having a plurality of channels 82. Support element 81 is typically alumina having a macroporous structure which is at the same time highly permeable and very strong, allowing operation under elevated temperature and pressure. Several layers of microporous ceramic material 83 are deposited in each channel 82. Housing the ceramic media is a filter housing 3 (FIG. 3), which is typically and preferably fine electropolished 316 L stainless steel for corrosion resistance.

While the ceramic filter media just described is preferred for sterilization of liquid cryogens, they may also be employed in sterilization of gaseous cryogens. Another preferred filter media, for both liquid and gaseous cryogen sterilization, are the filters known under the trade designation CHEM-LINE II PF, available from Millipore Co., Bedford, Mass. These filters comprise a plurality of polytetrafluoroethylene discs stacked upon each other and housed in a polytetrafluoroethylene housing. This construction allows a wide range of operating temperatures because of the similarity of the housing and disc materials. The filtration area for the CHEM-LINE II PF-40 filter is about 3350 $cm^2$, and for the 0.1 micrometer model has a flow rate of about 15 liters/min at a pressure differential of 8 psi. For the PF-80 model, the area is about 6700 $cm^2$, and for the 0.1 micrometer model has a flow rate of about 25 liters/min at a pressure differential of 8 psi. Both models have a maximum operating temperate of about 300° F. (149° C.).

D. Miscellaneous Equipment

As previously mentioned, diaphragm and bellows valves are preferred where sterility is to be maintained. For example, in FIG. 2, diaphragm valves are depicted at 52 and 17, although bellows valves may be used as well. Both diaphragm and bellows valves are well known in the mechanical arts for handling of toxic, hazardous, corrosive or expensive fluids, in pressurized systems at high or low temperatures, and for metering of minute quantities of fluids into vacuum systems. suitable for use in the present invention are diaphragm valves known under the trade designation DS and DL SERIES, from Nupro Company, Willoughby, Ohio. The diaphragms themselves are typically manufactured from 316 stainless steel. Suitable bellows valves include those available under the trade designation BM SERIES, also available from Nupro Company. The bellows is typically made from type 321 stainless steel when the valve body is bass or stainless steel.

Vacuum jacketed tubing and vacuum jacketed vessels are preferred for use in cryogenic service, although other means of insulation may be acceptable, such as foam insulation. Gauge guards are preferred for use for all pressure gauges, since they prevent possible contamination from the gauge itself into the sterile environment. Gauge guards are simply a sheet of material, typically stainless steel, which is positioned between the cryogen material and the material in the gauge itself (typically silicone fluid), thus preventing contamination of the system from the gauges.

Polytetrafluoroethylene and silicone gaskets are preferred throughout the apparatus, as are type 304 and 316 stainless steel tubing and compression fittings for food service.

Thermocouples are located on the apparatus in strategic locations not illustrated in the drawing figures. For example, it is preferred to position thermocouples near the filters to ensure that they have reached a temperature at which microbes will be killed when the apparatus is steam regenerated.

II. Method of Dispensing Sterile Cryogenic Liquid

In operation of the apparatus illustrated in the drawing, non-sterile cryogenic liquid, for example nitrogen at a pressure of about 120 PSIG enters the apparatus through conduit 70 (FIG. 3) and flows into reservoir 68. Reservoir 68 is typically held at a pressure ranging from about 20 to about 25 PSIG. Non-sterile cryogen then flows through conduit 2 up to filter housing 3. A portion of the non-sterile cryogen is used as a purge for filter media 60, and exits via recycle conduits 24 and 25 and pump 64 back to reservoir 68. Sterile cryogen exits via conduits 4 and 6 and restriction orifice 76. The relative flow rates of streams flowing through conduits 2, 4 and 24 depends essentially on pump 64 capacity. Taking as a basis that the flow through conduit 2 is 1 unit, the recycle flow may range from about 0.5 to about 0.8, while the flow of sterile cryogen through conduit 4 may range from about 0.2 to about 0.5. The pressure drop through the filter is preferably negligible, while the pressure drop across restriction orifice 76 typically and preferably ranges from about 0 to 5 PSI, more preferably from about 0 to 2 PSI. Sterile liquid cryogen then passes through conduit 6, level control valve 8, and conduit 10 on its way into accumulator 12, which is typically maintained at a pressure of ranging from about 15 to 20 PSIG, more preferably about 10 PSIG. Sterile cryogen is dispensed through conduits 14 and 18 and metering valve 16 into the customer's product.

In FIG. 1 an aseptic food canning line is illustrated at 1, wherein open cans of food 93 travel on a conveyor belt or other means 95. For a typical food canning operation, the amount of liquid cryogen dispensed depends mostly on the size of the can and the cryogen used, since liquid nitrogen will expand to a different gas volume than, say argon. If sterile liquid nitrogen is dispensed, about 1 to about 10 drops (about 0.1 to about 1.0 milliliter) is preferred. Cans 93 are immediately sealed, after dispensing of the liquid cryogen, using the customer's machinery, which is not shown and is not a part of the present invention. The pressure within hood 22 typically and preferably ranges from about atmospheric to about 5 inches of water, and the temperature is preferably about 200° F. to 250° F. (about 93° C. to about 121° C.).

Non-sterile gaseous cryogen, which may be the same or different than the liquid cryogen employed, enters the apparatus through conduit 26, pressure regulator 28, valve 30, and is sterilized in gas filter 32. The sterile cryogen is piped to sheath 40 through conduits 34 and 38. Valve 36 is normally closed, but when open it allows sterile gaseous cryogen to enter accumulator 12 through conduit 10, for example when it is desired to purge accumulator 12 and metering valve 16. Sterile gaseous cryogen is also routed though conduit 42 to gas passageway 44 during sterilization mode.

Various modifications and alterations of this invention will become apparent to those skilled in the art without departing from the scope thereof. It should be understood, therefore, that the scope of this invention is not to be limited to the illustrative embodiments set forth herein, but is to be determined by the limitations set forth in the claims and equivalents thereof.

What is claimed is:

1. An apparatus for producing and injecting a sterile cryogenic liquid, the apparatus comprising:

(a) at least one purge-swept cryogenic liquid filter, each comprising:

(i) a filter housing, (ii) a non-sterile cryogenic liquid inlet which accepts non-sterile cryogenic liquid from a source, (iii) a non-sterile cryogenic liquid purge stream outlet, (iv) a sterile cryogenic liquid outlet, the inlet and both outlets connected to the filter housing, and (v) filter media having the capability to effectively sterilize cryogenic liquids, the filter media positioned within the housing to accept non-sterile cryogenic liquid and produce sterile cryogenic liquid;

(b) at least one sterile cryogenic liquid accumulator having a sterile cryogenic liquid inlet which receives sterile cryogenic liquid from at least one filter via the sterile cryogenic liquid outlet, the sterile cryogenic liquid inlet having a first sterile cryogenic liquid passageway and a first sterile cryogenic gas passageway; and (c) the sterile cryogenic liquid accumulator comprising a sterile cryogenic liquid outlet for dispensing sterile cryogenic liquid, the sterile cryogenic liquid outlet having a second passageway for sterile cryogenic liquid and a second passageway for a sterile cryogenic gas, whereby sterile cryogenic gas may be delivered through the second sterile cryogenic gas passageway and substantially prevent contact of the sterile cryogenic liquid with a non-sterile atmosphere during dispensing of same.

2. Apparatus in accordance with claim 1 including a first cryogenic gas sterilization filter, the first cryogenic gas sterilization filter having a non-sterile cryogenic gas inlet which is in turn connected to a source of non-sterile cryogenic gas, and a sterile cryogenic gas outlet, the sterile cryogenic gas outlet connected to the first sterile cryogenic gas passageway.

3. Apparatus in accordance with claim 2 wherein the sterile cryogenic gas outlet is also connected with the second sterile cryogenic gas passageway.

4. Apparatus in accordance with claim 2 wherein at least the filter housing and the first cryogenic gas sterilization filter each comprise a steam condensate drain.

5. Apparatus in accordance with claim 1 wherein the accumulator comprises a gas vent connected to the second sterile cryogenic gas passageway, and between the accumulator and the gas vent there is provided a second cryogenic gas sterilization filter and a back-pressure control valve, thus ensuring the accumulator has a positive pressure to prevent back contamination from the atmosphere.

6. Apparatus in accordance with claim 5 wherein at least the filter housing and the second cryogenic gas sterilization filter each comprise a steam condensate drain.

7. Apparatus in accordance with claim 1 wherein the filter media is able to remove microbes having size greater than 0.45 micrometers.

8. Apparatus in accordance with claim 1 wherein the sterile cryogenic liquid inlet includes an accumulator level control valve interfaced with an accumulator level detector and accumulator level control unit.

9. Apparatus in accordance with claim 1 wherein the sterile cryogenic liquid outlet includes a connection to allow steam to enter at least non-sterile sections of the apparatus.

10. Apparatus in accordance with claim 1 wherein at least the filter housing comprises a steam condensate drain.

11. Apparatus in accordance with claim 1 wherein the non-sterile cryogenic liquid purge stream outlet includes a pump to return the non-sterile liquid to the non-sterile cryogenic liquid source.

12. Apparatus in accordance with claim 1 wherein the filter media is able to remove microbes having size greater than 0.2 micrometers.

13. A method of producing and dispensing a sterile cryogenic liquid, the method comprising the steps of:

(a) providing a non-sterile cryogenic liquid, the liquid comprising at least submicron microbes, the non-sterile cryogenic liquid being saturated;

(b) directing the non-sterile cryogenic liquid into at least one purge-swept cryogenic liquid filter, each liquid filter comprising:

(i) a filter housing, (ii) a non-sterile cryogenic liquid inlet which accepts non-sterile cryogenic liquid from a source, (iii) a non-sterile cryogenic liquid purge stream outlet, (iv) a sterile cryogenic liquid outlet, the inlet and both outlets connected to the filter housing, and (v) filter media having the capability to effectively sterilize cryogenic liquids, the filter media positioned within the housing to accept non-sterile cryogenic liquid and produce sterile cryogenic liquid;

(c) withdrawing a sterile cryogenic liquid from the liquid filter and directing it to a sterile cryogenic liquid accumulator, the accumulator having a sterile cryogenic liquid inlet which receives the sterile cryogenic liquid from the at least one liquid filter via the sterile cryogenic liquid outlet, the sterile cryogenic liquid inlet having a first sterile cryogenic liquid passageway and a first sterile cryogenic gas passageway, the sterile cryogenic liquid accumulator also comprising a sterile cryogenic liquid outlet for dispensing sterile cryogenic liquid, the sterile cryogenic liquid outlet having a second passageway for sterile cryogenic liquid and a second passageway for a sterile cryogenic gas, whereby sterile cryogenic gas is delivered through the second sterile cryogenic gas passageway and substantially prevents contact of the sterile cryogenic liquid with a non-sterile atmosphere during dispensing of same;

(d) directing non-sterile gaseous cryogen to at least one sterilizing gas filter and directing sterilized gaseous cryogen from said gas filter to said first and second gas passageways for sterile cryogenic gas; and (e) dispensing the sterile cryogenic liquid from the accumulator.

14. Method in accordance with claim 13 wherein there is a plurality of liquid filters.

15. Method in accordance with claim 14 wherein one liquid filter is in sterilization mode and the others of the plurality of liquid filters are in steam regeneration mode.

16. Method in accordance with claim 14 wherein all liquid filters are either in regeneration mode or in sterilization mode at any given time.

17. Method in accordance with claim 13 wherein all steps (a), (b), (c), (d) and (e) occur simultaneously.

18. Method in accordance with claim 13 wherein after a certain time period all flows are stopped, non-sterile and sterile liquid and gaseous cryogen are removed from the liquid and gaseous filters, and a regeneration material is introduced into the filters and all associated non-sterile equipment for a time and at a rate sufficient to regenerate the filters and equipment.

19. Method in accordance with claim 18 wherein the regeneration material is steam having sufficient temperature to kill microbes.

* * * * *